US009580091B2

(12) United States Patent
Kraeling et al.

(10) Patent No.: US 9,580,091 B2
(45) Date of Patent: Feb. 28, 2017

(54) SYSTEM AND METHOD FOR COMMUNICATING DATA IN A VEHICLE SYSTEM

(71) Applicant: General Electric Company, Schenectady, NY (US)

(72) Inventors: Mark Bradshaw Kraeling, Melbourne, FL (US); Wolfgang Daum, Waukesha, WI (US); Brian Lee Staton, Palm Bay, FL (US); Todd William Goodermuth, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/679,462

(22) Filed: Apr. 6, 2015

(65) Prior Publication Data

US 2015/0210302 A1 Jul. 30, 2015

Related U.S. Application Data

(63) Continuation-in-part of application No. 13/960,053, filed on Aug. 6, 2013, now abandoned, and a (Continued)

(51) Int. Cl.

| | |
|---|---|
| ***B61L 15/00*** | (2006.01) |
| ***G08G 1/00*** | (2006.01) |
| ***B61L 3/00*** | (2006.01) |

(52) U.S. Cl.

CPC ..... *B61L 15/0036* (2013.01); *B61L 3/006* (2013.01); *B61L 15/0027* (2013.01); *G08G 1/22* (2013.01)

(58) Field of Classification Search

None

See application file for complete search history.

(56) References Cited

U.S. PATENT DOCUMENTS 4,700,574 A 10/1987 Turbe
5,530,328 A * 6/1996 Fernandez ..... B60L 7/04 701/70

(Continued)

FOREIGN PATENT DOCUMENTS

CN 1451148 A 10/2003
CN 101184059 A 5/2008

(Continued)

OTHER PUBLICATIONS

McCartney et al., "Redundancy in measurement systems", World Pipelines, pp. 27-30, Feb. 2003.

(Continued)

*Primary Examiner* — John R Olszewski
*Assistant Examiner* — David Merlino
(74) *Attorney, Agent, or Firm* — John A. Kramer; Global Patent Operation

(57) ABSTRACT

A system includes a first communication module and a second communication module. The first communication module is configured to be disposed onboard a first vehicle of a vehicle consist, and the second communication module is configured to be disposed onboard a second vehicle of the vehicle consist. The first and second communication modules are communicatively coupled by first and second communication paths. The first and second communication modules are configured to communicate first information over the first communication path and second information over the second communication path. At least a portion of the first information includes a first command corresponding to a first operation of at least one of the first or second vehicles. At least a portion of the second information includes a second command corresponding to the first operation.

29 Claims, 5 Drawing Sheets

Related U.S. Application Data continuation-in-part of application No. 14/525,326, filed on Oct. 28, 2014, which is a continuation of application No. 14/152,517, filed on Jan. 10, 2014, now Pat. No. 8,903,574, which is a continuation-in-part of application No. 12/908,214, filed on Oct. 20, 2010, now Pat. No. 8,645,010, and a continuation-in-part of application No. 13/339,008, filed on Dec. 28, 2011, now abandoned, and a continuation-in-part of application No. 13/478,388, filed on May 23, 2012, now abandoned.

(60) Provisional application No. 61/720,018, filed on Oct. 30, 2012, provisional application No. 61/253,877, filed on Oct. 22, 2009.

(56) References Cited

U.S. PATENT DOCUMENTS

| | | | | |
|---|---|---|---|---|
| 5,681,015 | A * | 10/1997 | Kull | B61L 15/0027 701/20 |
| 5,720,455 | A * | 2/1998 | Kull | B61L 15/0027 246/187 C |
| 5,738,311 | A | 4/1998 | Fernandez | |
| 5,740,547 | A | 4/1998 | Kull et al. | |
| 5,777,547 | A * | 7/1998 | Waldrop | B61L 15/0036 246/167 R |
| 5,785,392 | A | 7/1998 | Hart | |
| 5,813,635 | A | 9/1998 | Fernandez | |
| 5,820,226 | A | 10/1998 | Hart | |
| 5,833,325 | A | 11/1998 | Hart | |
| 5,934,764 | A | 8/1999 | Dimsa et al. | |
| 5,950,967 | A | 9/1999 | Montgomery | |
| 5,969,643 | A | 10/1999 | Curtis | |
| 5,978,718 | A | 11/1999 | Kull | |
| 5,986,577 | A | 11/1999 | Bezos | |
| 5,986,579 | A | 11/1999 | Halvorson | |
| 5,995,881 | A | 11/1999 | Kull | |
| 6,128,558 | A | 10/2000 | Kernwein | |
| 6,163,089 | A | 12/2000 | Kull | |
| 6,216,095 | B1 | 4/2001 | Glista | |
| 6,275,165 | B1 | 8/2001 | Bezos | |
| 6,322,025 | B1 | 11/2001 | Colbert et al. | |
| 6,360,998 | B1 | 3/2002 | Halvorson et al. | |
| 6,377,215 | B1 | 4/2002 | Halvorson et al. | |
| 6,781,524 | B1 | 8/2004 | Clark et al. | |
| 6,782,044 | B1 | 8/2004 | Wright et al. | |
| 7,072,747 | B2 * | 7/2006 | Armbruster | B61L 15/0081 701/19 |
| 7,416,262 | B2 | 8/2008 | Ring | |
| 7,618,011 | B2 * | 11/2009 | Oleski | B61L 15/0036 701/19 |
| 7,653,465 | B1 | 1/2010 | Geiger et al. | |
| 7,715,956 | B2 * | 5/2010 | Bryant | B61L 15/0027 701/19 |
| 8,157,218 | B2 | 4/2012 | Riley et al. | |
| 8,428,798 | B2 | 4/2013 | Kull | |
| 9,108,640 | B2 | 8/2015 | Jackson | |
| 2002/0183901 | A1 | 12/2002 | Wolf et al. | |
| 2004/0100938 | A1 | 5/2004 | Aiken et al. | |
| 2004/0117073 | A1 * | 6/2004 | Horst | B61L 17/00 701/19 |
| 2005/0024001 | A1 | 2/2005 | Donnelly et al. | |
| 2005/0121971 | A1 | 6/2005 | Ring | |
| 2006/0025903 | A1 * | 2/2006 | Kumar | B61L 15/0081 701/19 |
| 2008/0246338 | A1 | 10/2008 | Donnelly et al. | |
| 2008/0306640 | A1 | 12/2008 | Rosenthal et al. | |
| 2009/0173839 | A1 | 7/2009 | Groeneweg et al. | |
| 2009/0248226 | A1 | 10/2009 | Kellner et al. | |
| 2010/0091663 | A1 * | 4/2010 | Takeyama | H04L 12/4625 370/242 |
| 2010/0241295 | A1 * | 9/2010 | Cooper | B61L 15/0036 701/19 |
| 2010/0286853 | A1 | 11/2010 | Goodermuth et al. | |
| 2011/0022253 | A1 * | 1/2011 | Chen | B61L 1/14 701/19 |
| 2011/0183605 | A1 * | 7/2011 | Smith, Jr. | B61L 15/0027 455/7 |
| 2011/0284700 | A1 * | 11/2011 | Brand | B61L 15/0036 246/28 R |
| 2012/0265379 | A1 * | 10/2012 | Chen | B61L 15/0036 701/20 |
| 2012/0290156 | A1 * | 11/2012 | Woo | B61L 15/0036 701/19 |
| 2014/0153380 | A1 * | 6/2014 | Luecke | H04W 56/0015 370/216 |
| 2015/0057846 | A1 * | 2/2015 | Fanara | B61L 15/0036 701/19 |

FOREIGN PATENT DOCUMENTS

| | | | |
|---|---|---|---|
| DE | 202010006811 | U1 | 7/2010 |
| KZ | 386 | U | 8/2008 |
| RU | 2025310 | C1 | 12/1994 |
| RU | 2238860 | C1 | 10/2004 |
| WO | 9960735 | A1 | 11/1999 |
| WO | 0076828 | A1 | 12/2000 |
| WO | 2007095402 | A2 | 8/2007 |
| WO | 2010039680 | A1 | 4/2010 |
| WO | 2012021225 | A2 | 2/2012 |
| ZA | 200101708 | A | 8/2001 |

OTHER PUBLICATIONS

Agenjos et al., "Energy Efficiency in Railways: Energy Storage and Electric Generation in Diesel Electric Locomotives", 20th International Conference on Electricity Distribution, Prague, pp. 1-7, Jun. 8-11, 2009.

Unofficial English Translation of Chinese Office Action issued in connection with related CN Application No. 201080059233.9 on Apr. 3, 2014.

A PCT Search Report and Written Opinion issued in connection with related PCT Application No. PCT/US2013/037951 on May 2, 2014.

A KZ Office Action issued in connection with related KZ Application No. 2014/1501.1 on Mar. 5, 2015.

A EA Office Action issued in connection with related EA Application No. 201290166 on Mar. 21, 2015.

A Chinese Office Action issued in connection with related CN Application No. 2013800266526.6 on Jul. 24, 2015.

A KZ Office Action issued in connection with related KZ Application No. 2014/1623.1 on Oct. 29, 2015.

* cited by examiner

SYSTEM AND METHOD FOR COMMUNICATING DATA IN A VEHICLE SYSTEM

CROSS-REFERENCE TO RELATED APPLICATIONS

This application is a continuation-in-part of U.S. application Ser. No. 13/960,053, filed 6 Aug. 2013, which claims priority to U.S. Provisional Application Ser. No. 61/720,018, filed 30 Oct. 2012, the contents of both of which are hereby incorporated by reference in their entireties.

This application is also a continuation-in-part of U.S. patent application Ser. No. 14/525,326, which was filed on 28 Oct. 2014, which is a continuation of U.S. patent application Ser. No. 14/152,517, which was filed on 10 Jan. 2014 (the "'517 Application") and is now U.S. Pat. No. 8,903,574 issued 2 Dec. 2014.

The '517 Application is a continuation-in-part of U.S. patent application Ser. No. 12/908,214, which was filed on 20 Oct. 2010 (the "'214 Application"), now U.S. Pat. No. 8,645,010 issued 4 Feb. 2014, and is a continuation-in-part of U.S. patent application Ser. No. 13/339,008, which was filed on 28 Dec. 2011 (the "'008 Application"), now abandoned, and is a continuation-in-part of U.S. patent application Ser. No. 13/478,388, which was filed on 23 May 2012 (the "'388 Application"), now abandoned.

The '214 Application claims priority to U.S. Provisional Application Ser. No. 61/253,877, which was filed on 22 Oct. 2009 (the "'877 Application").

The entire disclosures of the '517 Application, the '214 Application, the '877 Application, the '008 Application, and the '388 Application are incorporated by reference.

FIELD

Embodiments of the subject matter described herein relate to data communications over plural communication paths between different vehicles of a vehicle system in which the different vehicles are mechanically coupled to one another and travel as a group.

BACKGROUND

A vehicle system may include one or more powered vehicles that may be mechanically linked (directly or indirectly) to non-powered vehicles. The powered and non-powered vehicles of the vehicle system may travel as a group along a designated route. In cases where the vehicle system includes multiple powered vehicles, the vehicle system may coordinate operations of the powered vehicles to move the vehicle system. For example, a rail vehicle system may include a powered unit consist that has one or more powered units mechanically coupled to one or more non-powered rail cars. Vehicles in a consist may include a lead powered unit and one or more remote powered units and/or trail powered units. (Remote powered units are those that are spaced apart from the lead powered unit by one or more non-powered vehicles. Trail powered units are those that are in the same powered unit consist as the lead powered unit, and thereby not spaced apart from the lead powered unit by one or more non-powered rail vehicles, but that are subordinate to control by the lead powered unit.) The lead vehicle may control operation of one or more remote vehicles. More specifically, the lead vehicle (e.g., a lead locomotive) may coordinate tractive and braking operations of the different powered units (e.g., remote or trail locomotives) to control movement of the rail vehicle consist (e.g., a train). In some cases, a single train may include a plurality of such locomotive consists. The locomotive consists may communicate with one another to coordinate tractive and braking operations of the train.

In certain conventional vehicle systems, a lead vehicle communicates with remote powered vehicles via a multiple unit (MU) line. The information transmitted over the MU line is limited by the amount of wires or channels on the MU line. Thus, conventional MU communications do not identify a particular remote vehicle for which a command is intended. Instead, a similar command is sent to all remote vehicles. Similarly, conventional MU communications do not include information identifying a particular remote vehicle from which a status is sent. For example, a lead vehicle may receive an alarm, but not information indicating the particular remote vehicle from which the alarm was sent. Further, communications sent using conventional MU techniques may be quite limited in level of detail and/or fidelity.

These and other drawbacks of conventional communications among powered units of a consist may result in poor performance, limited flexibility of control, difficulty in troubleshooting and/or adjusting for changes in status of one or more vehicles, and the like.

BRIEF DESCRIPTION

In one embodiment a system is provided that includes a first communication module and a second communication module. As used herein, the terms "system" and "module" include a hardware and/or software system that operates to perform one or more functions. For example, a module or system may include a computer processor, controller, or other logic-based device that performs operations based on instructions stored on a tangible and non-transitory computer readable storage medium, such as a computer memory. Alternatively, a module or system may include a hard-wired device that performs operations based on hard-wired logic of the device. The modules shown in the attached figures may represent the hardware that operates based on software or hardwired instructions, the software that directs hardware to perform the operations, or a combination thereof.

The first communication module is configured to be disposed onboard a first vehicle of a vehicle consist, and the second communication module is configured to be disposed onboard a second vehicle of the vehicle consist. The first and second communication modules are communicatively coupled by first and second communication paths. The first and second communication modules are configured to communicate first information over the first communication path, and to communicate second information over the second communication path. At least a portion of the first information includes a first command corresponding to a first operation of at least one of the first or second vehicles. At least a portion of the second information includes a second command corresponding to the first operation.

In another embodiment, a system includes a lead communication module and plural remote communication modules. The lead communication module is configured to be disposed onboard a lead powered vehicle of a vehicle consist. The plural remote communication modules are configured to be disposed onboard corresponding plural remote powered vehicles of the vehicle consist. The lead and plural remote communication modules are communicatively coupled by a first communication path and a second communication path. The lead and remote communication modules are configured to communicate first information over the first communication path and second information over the second communication path. At least a portion of the first information includes a first command corresponding to a first operation of at least one of the remote vehicles, and at least a portion of the second information includes a second command corresponding to the first operation of the at least one of the remote vehicles.

In another embodiment, a method (e.g., a method for controlling operations of a consist) is provided that includes communicating first information via a first communication path to plural communication modules of plural respective remote powered vehicles of the consist. The first information includes a first command corresponding to a first operation, and is communicated from a lead communication module of a lead powered vehicle of the consist. The method also includes communicating second information including a second command also corresponding to the first operation. The second command is communicated via a second communication path that communicatively couples the lead powered vehicle and the remote powered vehicles. The second command is communicated from the lead communication module of the lead powered vehicle to at least one of the remote communication modules. The method also includes controlling at least one of the plural remote vehicles to perform the first operation pursuant to at least one of the first command or the second command.

BRIEF DESCRIPTION OF THE DRAWINGS

The inventive subject matter will be better understood from reading the following description of non-limiting embodiments, with reference to the attached drawings, wherein below.

DETAILED DESCRIPTION

Figure 1:
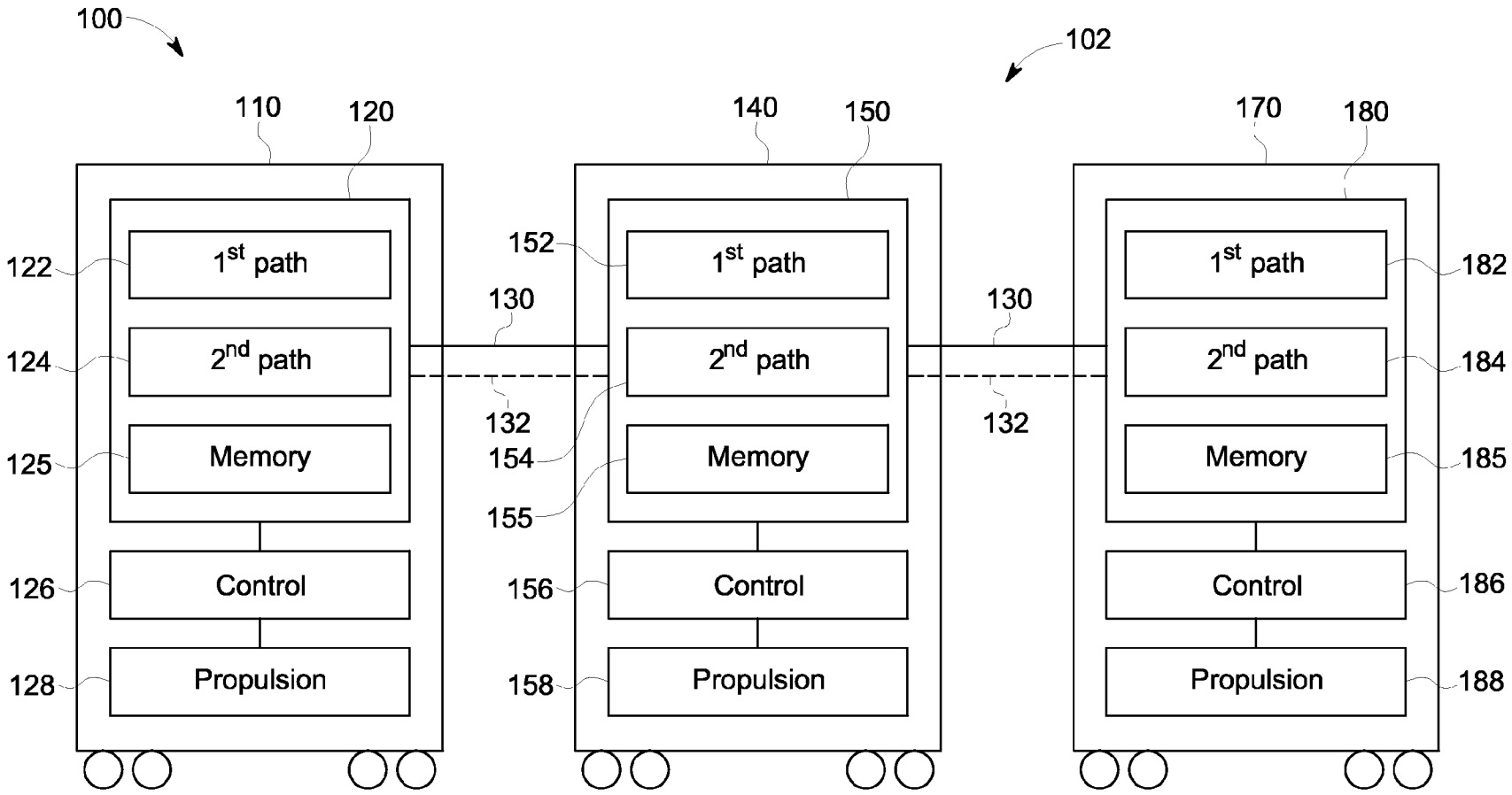
FIG. 1 is a schematic diagram of a communication and control system for a vehicle consist, according to an embodiment.

Throughout this document, the term vehicle consist is used. A vehicle consist can be a group of two or more vehicles that are mechanically coupled to travel together along a route. Optionally, a vehicle consist may have a single propulsion-generating unit or vehicle. The vehicles in a vehicle consist can be propulsion-generating units (e.g., vehicles capable of generating propulsive force, which also are referred to as propulsion-generating units, powered units, or powered vehicles) that may be in succession and connected together so as to provide motoring and/or braking capability for the vehicle consist. The propulsion-generating units may be connected together with no other vehicles or cars between the propulsion-generating units. One example of a vehicle consist is a locomotive consist that includes locomotives as the propulsion-generating units. Other vehicles may be used instead of or in addition to locomotives to form the vehicle consist. A vehicle consist can also include non-propulsion generating units, such as where two or more propulsion-generating units are connected with each other by a non-propulsion-generating unit, such as a rail car, passenger car, or other vehicle that cannot generate propulsive force to propel the vehicle consist. A larger vehicle consist, such as a train, can have sub-consists. Specifically, there can be a lead consist (of propulsion-generating units), and one or more remote consists (of propulsion-generating units), such as midway in a line of cars and another remote consist at the end of the train.

The vehicle consist may have a lead propulsion-generating unit and a trail or remote propulsion-generating unit. The terms "lead," "trail," and "remote" are used to indicate which of the propulsion-generating units control operations of other propulsion-generating units, and which propulsion-generating units are controlled by other propulsion-generating units, regardless of locations within the vehicle consist. For example, a lead propulsion-generating unit can control the operations of the trail or remote propulsion-generating units, even though the lead propulsion-generating unit may or may not be disposed at a front or leading end of the vehicle consist along a direction of travel. A vehicle consist can be configured for distributed power operation, wherein throttle and braking commands are relayed from the lead propulsion-generating unit to the remote propulsion-generating units by a radio link or physical cable. Toward this end, the term vehicle consist should be not be considered a limiting factor when discussing multiple propulsion-generating units within the same vehicle consist.

One or more embodiments of the inventive subject matter described herein provide methods and systems for communicating data in a vehicle system. The vehicle system may include a plurality of vehicles that are mechanically coupled or linked together (directly or indirectly) and communicatively coupled to each other. Each of the vehicles may have a corresponding vehicle network. Vehicles of the vehicle system may be joined by first and second communication paths (e.g., a first path and an alternate path), with information corresponding to a command for performance of a vehicle operation communicated over the first and second paths. Information sent over the second path may be used as a back-up for information sent over the first path (and/or information sent over the first path may be used as a back-up for information sent over the second path), may be used to supplement or provide greater detail regarding the operation to be performed than the information sent over the first path, and/or may be used as an alternate to information sent over the first path by one or more vehicles of the vehicle system.

Currently known multiple unit (MU) cable connections between powered rail vehicles carry signals for throttle, dynamic brake, direction, and the like. However, such communication systems do not include information identifying a particular vehicle as a recipient of a command or the source of a status message. Instead, identical commands are sent to all vehicles of a consist, and status messages are received without identifying the particular originating vehicle. Various embodiments add a second communication path (e.g., by overlaying a digital MU path over one or more wires of a MU cable, such as Ethernet over MU (eMU)) that provides for messages to be specific for a given vehicle. Such messages may include a sequence number or a time stamp indicating that the message is the most recent received (or indicating when a message was received). Systems utilizing such first and second communication paths may have some vehicles equipped to utilize either path and other vehicles equipped to utilize only one path, so that, for example, a lead powered vehicle may communicate with different remote vehicles using different paths (and/or different commands). For example, a conventional MU line may serve as a backup communication path for vehicles equipped to communicate using the alternate path, and as a sole or primary communication path for vehicles not so equipped.

A vehicle system may include one or more powered vehicles (or powered units) and one or more non-powered vehicles (or non-powered units). In certain embodiments, the vehicle system is a rail vehicle system that includes one or more locomotives and, optionally, one or more rail cars. In other embodiments, however, the vehicle system may include non-rail type vehicles, including off-highway vehicles (e.g., vehicles that are not designed or allowed by law or regulation to travel on public roads, highways, and the like), automobiles, marine vessels, and the like. In some cases, at least a plurality of the vehicles in a vehicle system may each include a separate vehicle network.

The data communicated between the vehicles may be network data. In some embodiments, "network data" includes data packets that are configured in a designated packet format. For example, data may be packaged into a data packet that includes a set of data bits that are arranged to form a control portion and a payload portion. The control portion of the data bits may correspond to addresses (e.g., source, destination), error detection codes (e.g., checksums), and sequencing information (e.g., timing information). The control portion may be found in packet headers and trailers of the corresponding data packet. The payload portion of the data bits may correspond to the information that was requested and/or is used by the vehicle system for a designated purpose, such as for making operational decisions and/or for controlling operations (e.g., tractive efforts, braking efforts, and the like) of the vehicle system. The payload portion may include operating data. Operating data may include different types of data from various components of a vehicle system that are used to control operation of the vehicle system. For example, the operating data may include information from sensors that indicates a performance level or state of a component of the vehicle system. For instance, fuel sensors may be configured to transmit signals that are indicative of a current fuel level or current fuel efficiency. In rail vehicle systems, sensors coupled to the engine or motors may transmit data that indicates a notch (or throttle) level of the rail vehicle system. Sensors may also be coupled to various elements of mechanical systems (e.g., motors, engines, braking systems) and transmit signals indicating when a corresponding element is properly operating or has failed. Operating data may also include information from data radios and global positioning system (GPS) units. GPS units may transmit information describing or indicating a position of the vehicle system. Data radios may transmit information regarding one or more different vehicles of the vehicle system.

With respect to the network data, the data packets may be packaged and communicated in accordance with a designated communications protocol. The designated communications protocol may include predetermined rules and formats for exchanging data packets between nodes or computing systems. Various communications protocols may be used for embodiments described herein including, but not limited to, an industry standard communications protocol, a proprietary communications protocol, and/or an open-source or publicly available communications protocol. In some embodiments, the data packets are packaged and communicated according to an Internet-layer type protocol for packet-switched internetworking. For example, the data packets may be packaged and communicated in accordance with Internet Protocol version 6 (IPv6) or in accordance with Internet Protocol version 4 (IPv4). Alternatively or additionally, the data packets may be packaged and/or communicated in accordance with another IP protocol version or another protocol. Network data may be generally configured for the Internet protocol suite, which may be referred to as TCP/IP due to the Internet protocol suite including the Transmission Control Protocol (TCP) and Internet Protocol (IP). Network data may also be configured according to the Session Initiated Protocol (SIP). Other communications protocols, however, exist and may be used by alternative embodiments. As described herein, certain portions of a system network may be configured for transmitting network data packets in a first packet format and other portions of the same system network may be configured for transmitting network data packets in a second packet format.

The data communicated between the vehicles may also be non-network data. Non-network data may be data that is not packaged or formatted according to the same communications protocol as the network data described herein. By way of example only, the non-network data may include legacy data that is communicated between vehicles using a protocol that is not an Internet-layer protocol. Although not packaged the same as network data, content of the non-network data may include information for operating or controlling the vehicle system (e.g., operating data as described above). The non-network data may also be transmitted over a different communication path than the network data (e.g., non-network data sent over a first path, and network data sent over a second path).

Embodiments described herein may transmit network data to or receive network data from operational components of a vehicle in the vehicle system. Operational components may be any component that can be used by a vehicle system and that is capable of being communicatively coupled to a network. Operational components may provide information to the vehicle system and/or may be instructed to operate in a designated manner by the vehicle system. Non-limiting examples of operational components include data radios, voice radios, control display units (CDUs) or user interfaces for the operator of the vehicle system (e.g., an engineer), positioning equipment (e.g., GPS units), data recorders, video recorders, engine control systems, power operational components (e.g., alternators, energy storage units), tractive operational components (e.g., inverters, motors, dynamic braking resistive grids), navigation equipment, traffic message channel (TMC) device, on-board computers, sensors for various tractive or braking sub-systems (e.g., sensors that detect a throttle setting or sensors that detect pressure in the brake line), and the like. Operational components may be configured to communicate network data that includes at least one of operating data, vehicle data, route data, or trip data. Operational components may also receive the network data to facilitate operation of the vehicle system. The received network data may include instructions for operating in a designated manner.

At least one technical effect of various embodiments described herein may include improved tailoring of commands for individual vehicles of a consist. Another technical effect may include improved identification of a particular vehicle or vehicles to which a status message corresponds. Another technical effect may include improved detail of status information and/or improved detail of command messages. Another technical effect may include provision of a redundant or back-up signal. Another technical effect may include improved compatibility of vehicles utilizing more recently developed communication techniques with vehicles using previously developed communication techniques.

FIG. 1 illustrates a schematic view of a communication and control system 100 for a vehicle consist 102 in accordance with an embodiment. The vehicle consist 102 of the depicted embodiment includes a first vehicle 110, a second vehicle 140, and a third vehicle 170. The vehicles 110, 140, 170 may be propulsion-generating vehicles. For example, the first vehicle 110 may be the lead powered unit of a consist, and the second vehicle 140 and the third vehicle 170 may be remote powered units of a consist. The vehicles 110, 140, 170 in some embodiments are rail vehicles, such as powered rail vehicles or locomotives. Messages or commands from the lead powered unit may be transmitted to the remote powered units to control one or more operations of the remote powered unit. In the illustrated embodiment, the lead powered unit is depicted at a front end of the consist; however, in some embodiments, the lead powered unit need not necessarily be disposed at a leading end of the consist.

The first vehicle 110 includes a first communication module 120, a control module 126, and a propulsion module 128. The control module 126 is configured to develop and/or communicate control messages to operational aspects of the first vehicle 110, such as the propulsion module 128. The propulsion module 128 is configured to propel the vehicle 110 along a route, such as a railroad track. The propulsion module 128 may include, for example, wheels and drive assemblies, as well as braking components or systems, such as dynamic braking components or systems. In some embodiments, for example, where the first vehicle 110 is configured as the lead vehicle of the consist 102, the control module 126 may be configured to develop a trip plan including a series of propulsion commands to be performed by each of the vehicles 110, 140, 170 to perform a mission.

The first communication module 120 is configured to send and receive information to and from other vehicles of the consist 102. For example, the first communication module 120 may be configured to develop and send messages including propulsion commands to the second vehicle 140 and the third vehicle 170, and to receive status messages from the second vehicle 140 and the third vehicle 170. Information from the status messages may be used to determine a future command to the second vehicle 140 and/or third vehicle 170, to revise a trip plan, or the like.

In the illustrated embodiment, the first communication module 120 includes a first path communication module 122, a second path communication module 124, and a memory 125. The first path communication module 122 is configured to construct, send, receive, and/or analyze messages or information sent over a first communication path 130 (e.g., a non-network path). The second path communication module 124 is configured to construct, send, receive, and/or analyze messages or information sent over a second communication path 132 (e.g., a network path).

The second vehicle 140 includes a second communication module 150, a control module 156, and a propulsion module 158. The control module 156 is configured to communicate control messages (e.g., control messages received from the control module 126 of the first vehicle 120) to operational aspects of the second vehicle 150, such as the propulsion module 158. The propulsion module 158 is configured to propel the second vehicle 150 along a route, such as a railroad track. The propulsion module 158 may include, for example, wheels and drive assemblies, as well as braking components or systems, such as a dynamic braking system.

The second communication module 150 is configured to send and receive information to and from one or more other vehicles of the consist 102. For example, the second communication module 150 may be configured to receive propulsion commands for the second vehicle 140 from the first vehicle 110, and to provide status messages regarding the second vehicle 140 to the first vehicle 110.

In the illustrated embodiment, the second communication module 150 includes a first path communication module 152, a second path communication module 154, and a memory 155. The first path communication module 152 is configured to construct, send, receive, and/or analyze messages or information sent over the first communication path 130. The second path communication module 154 is configured to construct, send, receive, and/or analyze messages or information sent over a second communication path 132.

Generally similarly, the third vehicle 170 includes a third communication module 180, a control module 186, and a propulsion module 188. The control module 186 is configured to communicate control messages (e.g., control messages received from the control module 126 of the first vehicle 120) to operational aspects of the third vehicle 180, such as the propulsion module 188. The third communication module 180 is configured to send and receive information to and from one or more other vehicles of the consist 102. For example, the third communication module 180 may be configured to receive propulsion commands for the third vehicle 170 from the first vehicle 110, and to provide status messages regarding the third vehicle 170 to the first vehicle 110.

In the illustrated embodiment, the third communication module 180 includes a first path communication module 182, and a second path communication module 184, and a memory 185. The first path communication module 182 is configured to construct, send, receive, and/or analyze messages or information sent over the first communication path 130. The second path communication module 184 is configured to construct, send, receive, and/or analyze messages or information sent over the second communication path 132.

The first communication path 130 and the second communication path 132 link one or more communication modules of additional vehicles with the first communication module 120. For example, in the illustrated embodiment, communication modules of the second vehicle 140 and third vehicle 170, respectively, are communicatively coupled with the first communication module 120 via the first communication path 130 and the second communication path 132. Additional modules of additional vehicles (not shown) may also be communicatively linked with the first communication module 120.

The first communication path 130 and the second communication path 132 are depicted schematically in FIG. 1 as separate lines (the first communication path 130 as a solid line and the second communication path 132 as a dashed line) for clarity of explanation, but need not be physically separate. In some embodiments, the first communication path 130 and the second communication path 132 are physically separate, while in other embodiments at least a portion of the first communication path 130 and the second communication path 132 are not physically separate. In some embodiments, both the first communication path 130 and the second communication path 132 are hard-wired connections physically coupling two or more consecutively positioned powered units (e.g., without any units not including or coupled to the first communication path 130 and second communication path 132 disposed therebetween).

For example, in some embodiments, the first communication path 130 is a multiple unit (MU) connection that may use industry standard MU signals to communicate information between units. For example, the first communication path 130 may include a standard 27 pin cable. (See also FIGS. 2-4 and related discussion.) As used herein, an industry standard may be understood as a designated communication protocol and/or physical interface for communications over MU lines, which has been adopted for a given region by plural manufactures of vehicles that include MU lines in that region, for interoperability.

As indicated above, in various embodiments, the second communication path 132 may be physically separate from the first communication path 130. In some embodiments, the second communication path 132 may include a physically separate hardwired connective path including, for example, an Ethernet cable connection. In other embodiments, the second communication path 132 and the first communication path 130 may traverse the same physical structure, but use distinct message communication techniques. For example, as indicated above, the first communication path 130 may be a multiple unit connection that may use industry standard MU signals to communicate information between units, and the second communication path 132 may be a path by which modulated signals are transmitted over one or more of the component lines or channels of the MU connection. For example, the second communication path 132 may include an Ethernet over MU configuration.

The second communication path may be understood as an alternate communication path. Such an alternate communication path may follow, for example, a physically separate hardwired connection, or, as another example, utilize a common hardwired connection as the first communication path, but utilize a different communication technique, such as sending a modulated signal that is overlayed on a signal used for the first communication path. An alternate communication path may be understood as a distinct physical structure, communication technique, or communication protocol used to convey information at or near a same time as information is conveyed via a first path.

In the illustrated embodiment, first information is communicated via the first information path 130, and second information is communicated over the second information path 132. At least portions of the first and second information both correspond to a same or similar operation—for example, a throttle command to one or more remote or trail vehicles, a brake command to one or more remote or trail vehicles, or a direction command (e.g., forward, reverse, neutral) to one or more remote or trail vehicles. The first and/or second information may also include status messages, for example, from one or more remote or trail vehicles to a lead vehicle.

While the first and second information may correspond to the same or similar operation, the second communication path 132 may be configured to include more detailed, complete, and/or additional information compared to the first information communicated via the first communication path 130. For example, the second information may include additional commands. As another example, the second information may include a similar command or status but additional detail and/or additional commands or status information. As yet another example, the second information may include information identifying a particular one or ones of plural remote or trail vehicles as the intended recipient of a command and/or as the source of a status. As still another example, the second information may include a similar command as the first information, but at a higher fidelity. As one more example, the second information may include timing information indicating a timing, or a location within a sequence, corresponding to a particular command or status message.

As indicated above, the second information (communicated over the second communication path 132) may include command information at a higher fidelity than command information than the first information (communicated over the first communication path 130). For example, due to the limited amount of information that may be conveyed over a conventional 27-pin MU configuration, throttle settings may be communicated only at integer levels corresponding to notches (e.g., 1, 2, 3, 4, 5, 6, 7, or 8). However, with a second or alternative path (e.g. second communication path 132) having more capacity for information, higher fidelity throttle settings, (e.g., 7.2, 7.25) may be communicated, allowing for finer precision in selecting and controlling a throttle setting for one or more powered vehicles. Thus, the first information and second information may correspond to the same operation of a given remote or trail powered unit (e.g., a throttle notch setting), but with the second information at a higher fidelity than the first information (e.g., a throttle setting of 7.2 compared to a throttle setting of 7). With command information being communicated over both paths, the first communication path 130 and the second communication path 132 in some embodiments provide for redundancy and/or a back-up of at least a portion of a command. For example, in one example scenario, a trip plan calls for a remote powered vehicle to operate at a throttle setting of 7.2. To achieve the desired throttle setting, the second path communication module 124 of the first communication module 120 transmits information including a command for a throttle setting of 7.2 over the second communication path 132. At or about the same time, the first path communication module 122 of the first communication module 120 transmits information including a command for a throttle setting of 7 over the first communication path 130 (where the first path 130 is limited to integers for throttle settings). In some embodiments, if the command sent along the second communication path 132 (e.g., a throttle setting of 7.2) is not properly received or is unable to be implemented, then the command sent along the first communication path 130 (e.g., a throttle setting of 7) may be used as a back-up.

The second information may include similar information to the first information, but also include a greater amount of information or detail. For example, because the first communication path may have a generally highly limited information-carrying capacity (e.g., limited by the amount of information that can be conveyed using a standard 27-pin MU configuration), any status information sent by one or more trail or remote powered vehicles to another vehicle, such as a lead powered vehicle of a consist, may be limited to an alarm that indicates a potential issue, without providing detail. Additional information, however, regarding a status may be sent over the second communication path 132. As an example scenario, a remote powered vehicle may be experiencing a low fuel condition. The first communication path 130 may allow only an alarm to be sent via the first communication path 130, whereas the second communication path 132 may have the capacity to carry additional information, such as that the alarm relates to a low fuel condition, and, in some embodiments, provide information regarding how much fuel is remaining. As another example, a remote powered vehicle may experience a dynamic brake failure. Under a conventional MU configuration, a particular portion of the MU cable (e.g., pin 20) may be configured to provide a dynamic brake warning. More detailed information regarding the nature of the dynamic brake warning (e.g., whether the vehicle still has some braking capacity and/or how much braking capacity remains) may be provided via the second communication path 132.

Yet further still, the second information (communicated via the second communication path 132) may include additional further information identifying a particular remote vehicle or group of remote vehicles as a recipient of information (e.g., a command from a lead powered vehicle) or as a source of information (e.g., a status sent to a lead powered vehicle). Continuing the example scenario discussed above, information sent over the first communication path 130 (e.g., a standard MU line) may not include any information identifying the source of the alarm, whereas information (e.g. a status message) sent over the second communication path 132 may include information identifying the particular vehicle from which the status message originates. Thus, the information sent over the second communication path 132 may include not only an alarm message (e.g., confirming an alarm received at or near a similar time over the first communication path 130), but also include more detailed information concerning the nature of the alarm as well as identifying information corresponding to the source of the alarm.

Information sent over the second communication path 132 may include identifying information corresponding to a particular vehicle or group of vehicles (e.g., a group of vehicles that is less than an entire set of vehicles joined by the first and second communication paths) that is an intended recipient of a command. The identifying information may include, for example, an address or signature associated with a particular vehicle. Thus, in some embodiments, a command may be sent for performance of an operation by an individual vehicle or group of vehicles while not being performed by other vehicles communicatively linked by the first communication path 130 and the second communication path 132. For example, a command for a vehicle control operation (e.g., a throttle notch setting) may be sent from the first communication module 120 of the first vehicle 110 via the first communication path 130. However, because a standard MU configuration does not include identifying information for a particular individual vehicle or group of vehicles, a command sent via a standard MU configuration cannot be tailored for an individual vehicle or group of vehicles. The second communication path 132 in some embodiments is configured to allow identifying information to be included that identifies a particular vehicle for performance of a given command. Thus, individually tailored commands (e.g., throttle settings, braking activities, and the like) may be sent to individual vehicles for improved control of a consist. In some embodiments, intra-consist routing software may be used to create routes and facilitate delivery of command and/or status messages over the second communication path 132. Such routing may use a proxy identification technique of routing to send message. In some embodiments, when a lead vehicle is determined, a route request may be sent to all other vehicles from the lead vehicle, and when a trail vehicle is determined, a route request may be sent to the lead vehicle from the trail vehicle. Thus, routing may be dynamic, and responsive to additions or changes in the consist.

In some embodiments, the control module 126 may be configured to utilize information sent via the second communication path 132 to adjust control of one or more specific vehicles. In one example scenario, the first vehicle 110 may receive information over the second communication path indicating that the second vehicle 140 is running low on fuel. The first control module 126 may then adjust a previously determined trip plan to reduce a throttle setting of the second vehicle 140 to conserve fuel available to the second vehicle 140, by sending a message identifying the second vehicle 140 as the recipient of a command for a reduced throttle setting. The first control module 126 may also adjust the trip plan to increase a throttle setting of a different vehicle to account for the reduced power being provided by the second vehicle 140. For example, a message including a command for an increased throttle setting (as well as information identifying the third vehicle 170 as the intended recipient of the command) may be sent to the third vehicle 170. Further still, other vehicles (not shown) may not receive adjusted command messages and continue to run at a previously determined throttle setting. In some embodiments, some vehicles may be controlled using a first command (e.g., a default command) sent over the first communication path 132, while one or more other vehicles may be controlled using specifically tailored commands. For example, newer and/or more efficient powered vehicles may be operated at higher throttle settings than older and/or less efficient powered vehicles. In some embodiments, a first group of vehicles (e.g., newer vehicles) may be equipped to communicate over both the first communication path 130 and the second communication path 132, while a second group of vehicles (e.g., older vehicles) may not be equipped to communication over the second communication path 132. (See also FIG. 5 and related discussion.) As another example, one or more vehicles may receive a command tailored to adjust control based on a status message (e.g., low fuel).

In some embodiments, information sent over the second communication path 132 may include call and response confirmation information. For example, a command message may be sent over the second communication path 132 to the second and third vehicles 140, 170, from the first vehicle 110. Upon successful receipt of the message, the communication modules of the second and third vehicles 140, 170 may send confirmation messages to the communication module 120 of the first vehicle 110. The confirmation messages may include identifying information allowing the communication module 120 and/or the control module 126 of the first vehicle 110 to determine which vehicles have successfully received a given message and which vehicles have not received a given message.

In some embodiments, information sent over the second communication path 132 may include timing information. For example, a command (or status) message sent via the second communication path 132 may include timing information corresponding to a timing of when the given command (or status) was created and/or sent. In some embodiments, the timing information may include a time stamp. In other embodiments, the timing information may include a sequence number or other identifier corresponding to the location of a message within a sequence. The timing information may be used by a recipient communication module (or vehicle associated with a recipient communication module) to determine if a received message is current. For example, if a command is determined to be current, the command may be followed. However, if the command is determined not to be current, then a different command (e.g., a command received via the first communication path 130) may be implemented instead. The determination of whether or not a command is current may be made by determining if the timing information associated with a command exceeds a threshold. For example, if an elapsed time since the sending of a command message exceeds a threshold (e.g., as determined using a time stamp or indicator associated with the command message), the command may be disregarded, and a command received via the first communication path 130 implemented. However, if the elapsed time does not exceed the threshold, the command may be considered current, and the command received via the second communication path 132 may be implemented while the command received via the first communication path 130 is disregarded. Similarly, status messages sent from one or more communication modules (e.g., communication modules of remote powered vehicles) may include timing information to allow a recipient lead powered vehicle to determine the currency of a given status message.

In some embodiments, information transmitted via the second path 132 may include information configured to check the integrity of an associated message. For example, information sent over the second path may include a CRC that allows a message sent over the second path to be checked. If a test of the CRC is satisfactory, then the message may be used, but if the CRC is not satisfactory, then the message may be disregarded. In some embodiments, if the CRC is not satisfactory, the intended recipient may alert the source of the message and/or a new message may be requested.

Figure 2:
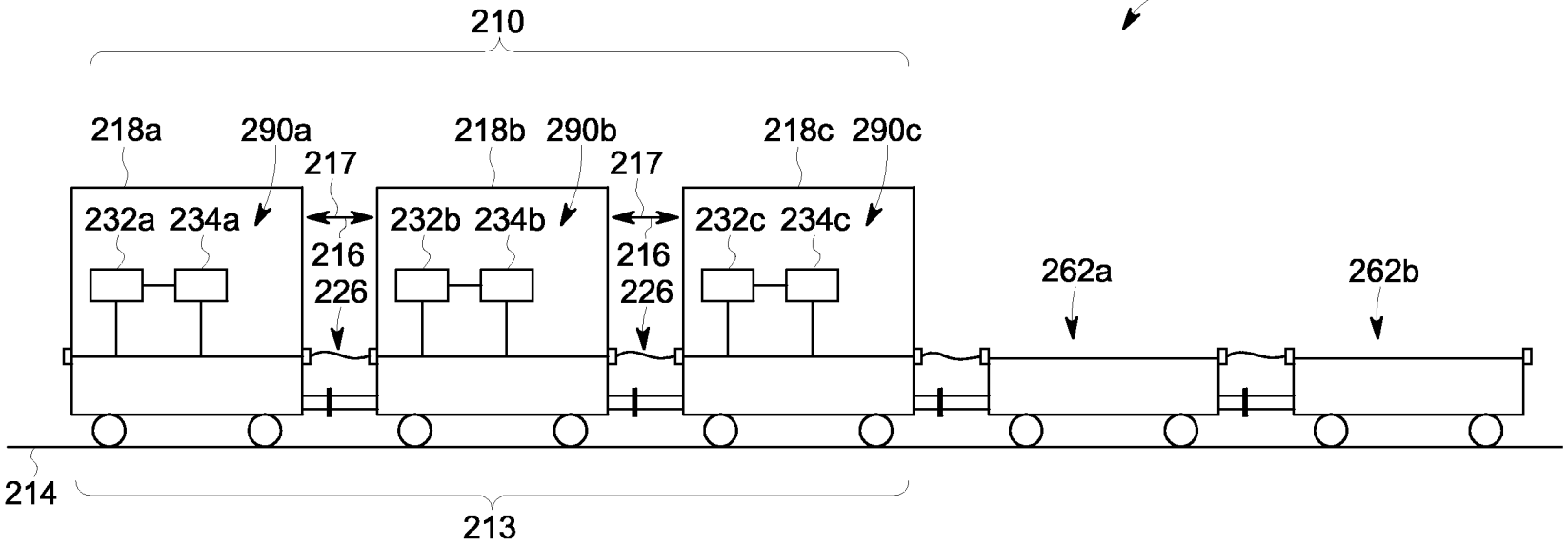
FIG. 2 is a schematic diagram of a communication system for communicating data in a vehicle consist, according to an embodiment.

FIG. 2 illustrates a system network (or communication system) 210 of a vehicle system 212 formed in accordance with one embodiment. The vehicle system 212 includes a plurality of vehicles (or units) 218*a*-218*c* and 262*a*, 262*b* that are mechanically coupled to one another, and are configured to traverse a route 214. In some embodiments, the vehicles may be rail vehicles (e.g., locomotives) and the route 214 may include railroad tracks. In some embodiments, the vehicle system 212 includes one or more vehicle consists 213. Different vehicles of a vehicle consist may coordinate operations (e.g., tractive and braking efforts) with other vehicles in the consist to move the vehicle consist and, consequently, the vehicle system. The vehicle system 212 may include only a single vehicle consist or a plurality of vehicle consists. For such embodiments that include multiple vehicle consists, each vehicle consist may coordinate operations with other vehicle consists to move the vehicle system. For example, individual consists may communicate with each other via a wireless communication system.

In the illustrated embodiment, the vehicle system 212 is configured including a single vehicle consist that includes multiple vehicles or units. In other embodiments, however, the vehicle system 212 may include a plurality of vehicle consists that are directly or indirectly linked to one another in the vehicle system 212. As shown, the vehicle system 212 includes a plurality of powered vehicles 218*a*-218*c*. As used herein, a "powered vehicle" is a vehicle that is capable of self-propulsion. The vehicle system 212 may also include non-powered vehicles (or units) 262*a*, 262*b* that do not provide propulsive efforts. In the illustrated embodiment, the non-powered vehicles 262*a*, 262*b* are rail cars used for cargo and/or carrying passengers. The term "powered," however, refers to the capability of the powered vehicles 218*a*-218*c* to propel themselves and not to whether the powered vehicles 218*a*-218*c* or the non-powered vehicles 262*a*, 262*b* receive energy (e.g., electric current) for one or more purposes. For example, the non-powered vehicles 262*a*, 262*b* may receive electric current to power one or more loads disposed onboard the non-powered vehicles 262*a*, 262*b*.

In some embodiments, the vehicle 218*a* controls operation of the vehicles 218*b* and 218*c* and, as such, the vehicle 218*a* may be referred to as a lead vehicle and the vehicles 218*b*, 218*c* may be referred to as remote vehicles or trail vehicles. The vehicles 218*b*, 218*c* may or may not trail the vehicle 218*a* when the vehicle system 212 is in motion. In alternative embodiments, however, control of the different operations of the vehicle system 212 may be distributed among a plurality of the vehicles. In the illustrated embodiment, each of the vehicles 218*a*-218*c* is adjacent to and mechanically coupled with another vehicle in the vehicle system 212 such that each and every vehicle is directly or indirectly connected to the other vehicles. In one or more embodiments, the non-powered vehicles 262*a*, 262*b* may be positioned before, after, or between the powered vehicles 218*a*-218*c*.

The system network 210 may include a plurality of sub-networks. For example, the system network 210 may be a wide area network (WAN) and the sub-networks may be local area networks (LANs). In the illustrated embodiment, each of the vehicles 218*a*-218*c* includes a corresponding vehicle network 290*a*-290*c*, respectively. In some embodiments, the vehicle networks 290*a*-290*c* may constitute separate LANs that are part of a WAN (e.g., the system network 210). Although not shown, the vehicles 262*a*, 262*b* may also include a vehicle network in alternative embodiments.

In some embodiments, the system network 210 corresponds to a single vehicle consist (e.g., the vehicle consist 213). The vehicle system 212 may have a plurality of vehicle consists and, as such, the vehicle system 212 may include a plurality of system networks. Accordingly, in some embodiments, a single vehicle system 212 may include multiple WANs in which at least one of the WANs includes a plurality of vehicle networks (or LANs). In such embodiments, each of the vehicle consists may coordinate operations among the vehicles to move the vehicle system. The vehicle consists may also coordinate operations with one another to move the vehicle system.

Each of the vehicle networks 290*a*-290*c* may include a plurality of operational components 232*a*-*c* that are communicatively coupled to the corresponding vehicle network. Each of the operational components may have a network address (e.g., IP address) within the corresponding vehicle network. The network address may be a static or designated address that is established or assigned by an industry or proprietary standard or the address may be a dynamic address designated by the system network 210. Data may be transmitted between the different vehicles 218*a*-218*c* of the vehicle system 212 or, more specifically, between the different vehicle networks 290*a*-290*c*. For example, data may be transmitted from the vehicle 218*a* to the vehicle 218*b*. In some embodiments, data transmitted within the vehicle networks 290*a*-290*c* (e.g., intra-network) is configured for one communications protocol, and data transmitted between the vehicle networks 290*a*-290*c* in the system network 210 (e.g., inter-network) is configured for a different communications protocol. Further still, data transmitted between the vehicle networks 290*a*-290*c* may be transmitted along multiple paths using different techniques (e.g., data 216 sent using a standard MU format over a first path, and data 217 sent using an eMU format over a second path).

As shown in FIG. 2, data 216, 217 may be transmitted over a communication channel or line, such as a multiple unit (MU) cable system 226. The MU cable system 226 may include an electrical bus that interconnects the lead powered vehicle 218*a* and the remote powered vehicles 218*b*, 218*c* in the vehicle system 212.

In some embodiments, a portion of the data may be transformed (e.g., modified, modulated, and/or converted) prior to transmission over the MU cable system 226. The transformed network data is indicated at 217. For example, transformed network data may be data that is at least one of encapsulated or modulated. When data is encapsulated and/or modulated, the data may be changed from one form to a second, different form. Depending on the form, the data may be configured for transmission within a vehicle network or, separately, may be configured for transmission between vehicle networks. This transformed network data may be subsequently decapsulated (or translated) or demodulated such that the data is changed from the second form to the first form. In other embodiments, the data may be changed from the second form to a different, third form when the modified data is decapsulated or demodulated.

By way of example, in some embodiments, the data may be transformed to have different packet formats as the data is communicated throughout the system network 210. For example, the data 216 may be configured according to one type of communications technique (e.g., standard 27-pin MU communications) so that the data 216 may be communicated via a first communication path. Additional data 217 may be communicated according to another type of communications technique via a second communication path (e.g., eMU) so that the data 217 may be transmitted along an alternate path configured to provide redundancy of and/or addition or modification to information sent via the first communication path.

For various communication functions, the system network 210 may include router transceiver units 234*a*, 234*b*, 234*c* that are disposed on-board the vehicles 218*a*, 218*b*, 218*c*, respectively, and are described in greater detail below. The router transceiver units 234*a*, 234*b*, 234*c* may be communicatively coupled to operational components 232*a*, 232*b*, 232*c*, respectively, which are also disposed on-board the respective vehicles.

Figure 3:
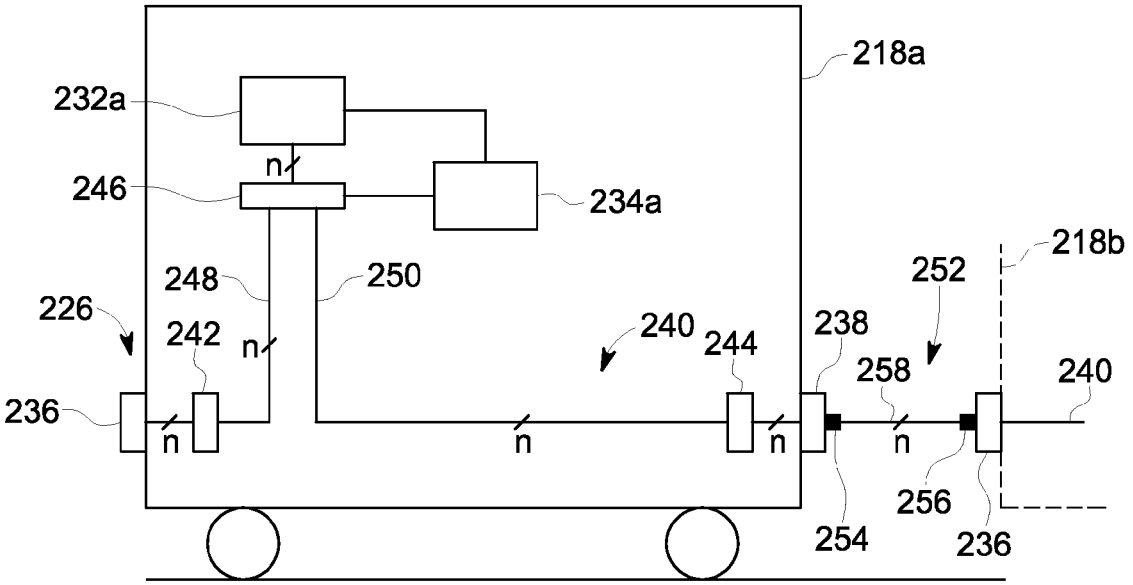
FIG. 3 is a schematic diagram of a multiple unit (MU) cable system in a vehicle, shown in the context of the system network of FIG. 2.

FIG. 3 shows aspects of the vehicle 218*a* and the MU cable system 226 in greater detail according to an embodiment. However, it should be noted that FIG. 3 illustrates one example of a powered vehicle and MU cable system and that other configurations may be possible. In some embodiments, the MU cable system 226 may be an existing electrical bus interconnecting the vehicle 218*a* and the vehicles 218*b*, 218*c* in the vehicle consist 213 (see FIG. 2). In the illustrated embodiment, for each of the vehicles 218*a*-218*c*, the MU cable system 226 comprises a first MU port 236, a second MU port 238, and an internal MU electrical system 240 that connects the first port 236 and the second port 238 to one or more operational components 232*a* of the vehicle 218*a*. In the example embodiment depicted in FIG. 3, the internal MU electrical system 240 comprises a first terminal board 242 electrically connected to the first MU port 236, a second terminal board 244 electrically connected to the second MU port 238, a central terminal board 246, and first and second electrical conduit portions 248, 250 electrically connecting the central terminal board 246 to the first terminal board 242 and the second terminal board 244, respectively. The one or more operational components 232*a* of the vehicle 218*a* may be electrically connected to the central terminal board 246 and, thereby, to the MU cable system 226 generally.

Figure 4:
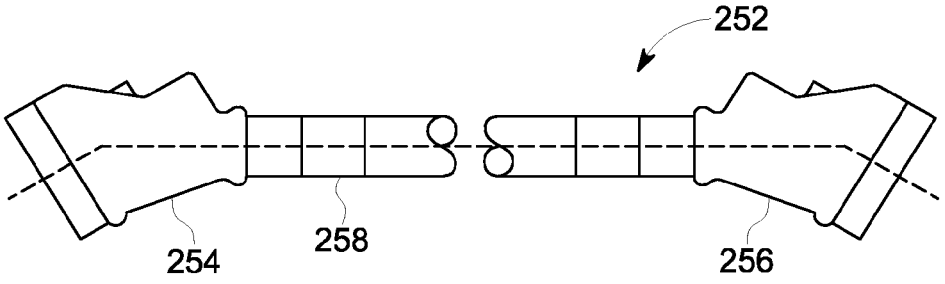
FIG. 4 is a schematic diagram of an MU cable jumper.

As shown in FIGS. 3 and 4, the MU cable system 226 further comprises an MU cable jumper 252. The jumper 252 comprises first and second plug ends 254, 256 and a flexible cable portion 258 electrically and mechanically connecting the plug ends together. The plug ends 254, 256 fit into the MU ports 236, 238. The MU cable jumper 252 may be electrically symmetrical, meaning either plug end can be attached to either port. The MU cable jumper 252 is used to electrically interconnect the internal MU electrical systems 240 of the adjacent vehicles 218*a*, 218*b*. As shown in FIG. 3, for each adjacent pair of vehicles 218*a*, 218*b*, one plug end 254 of an MU cable jumper 252 is attached to the second MU port 238 of the powered vehicle 218*a*, and the other plug end 256 of the MU cable jumper 252 is attached to the first MU port 236 of the powered vehicle 218*b*. The flexible cable portion 258 of the MU cable jumper 252 extends between the two plug ends, providing a flexible electrical connection between the two vehicles 218*a*, 218*b*. In some embodiments, information is transmitted over the MU cable system 126 over a first communication path (e.g., first communication path 132) according to a designated voltage carrier signal (e.g., a 74 volt on/off signal, wherein 0V represents a digital "0" value and +74 volts a digital "1" value, or an analog signal of 0V-74V, wherein the 0-74V voltage level may represent a specific level or percentage of functionality).

The cable portion 258 (of the MU cable jumper 252) may include a plurality of discrete electrical wires, while the conduit portions 248, 250 each include one or more discrete electrical wires and/or non-wire electrical pathways, such as conductive structural components of the vehicle, pathways through or including electrical or operational components, circuit board traces, or the like. Although certain elements in FIG. 3 are shown as including "n" discrete electrical pathways, it should be appreciated that the number of discrete pathways in each element may be different, i.e., "n" may be the same or different for each element.

In some embodiments, the plug ends 254, 256 may include a plurality of electrical pins, each of which fits into a corresponding electrical socket in an MU port. The number of pins and sockets may depend on the number of discrete electrical wires or channels extant in the internal electrical system 240, MU cable jumper 252, etc. In one example, each plug end 254, 256 is a twenty seven-pin plug.

The central terminal board 246, the first terminal board 242, and the second terminal board 244 may each comprise an insulating base (attached to the vehicle) on which terminals for wires or cables have been mounted. This may provide flexibility in terms of connecting different operational components to the MU cable system.

Depending on the particular type and configuration of the vehicle, the electrical conduit portions 248, 250 and MU cable jumpers 252 may be configured in different manners, in terms of the number "n" ("n" is a real whole number equal to or greater than 1) and type of discrete electrical conduits. In one example, each conduit portion 248, 250 and the jumper cable portion 258 include a plurality of discrete electrical wires, such as 12-14 gauge copper wires. For example, the MU cable system 226 may include 27 wires (and corresponding pins) configured corresponding to a standard MU configuration as listed in the following table:

| MU Pin Number | Function Name | Signal Originator |
|---|---|---|
| 1 | Power Reduction (Analog) | Lead |
| 2 | Alarm Bell | Lead or Trail |
| 3 | "D" Governor Solenoid | Lead |
| 4 | Negative Voltage Common | N/A |
| 5 | Emergency Sand | Lead |
| 6 | Generator (Main Alternator) Field | Lead |
| 7 | "C" Governor Solenoid | Lead |
| 8 | Reverse | Lead |
| 9 | Forward | Lead |
| 10 | Wheel Slip Indicator [in some embodiments, eMU carrier] | Lead or Trail |
| 11 | Spare | N/A |
| 12 | "B" Governor Solenoid | Lead |

-continued

| MU Pin Number | Function Name | Signal Originator |
|---|---|---|
| 13 | Control Circuits and Fuel Pump | Lead |
| 14 | Spare | N/A |
| 15 | "A" Governor Solenoid | Lead |
| 16 | Engine Run | Lead |
| 17 | Dynamic Brake Control | Lead |
| 18 | Spare | N/A |
| 19 | Spare | N/A |
| 20 | Dynamic Brake Warning [in some embodiments, eMU carrier] | Lead or Trail |
| 21 | Dynamic Brake Interlock | Lead |
| 22 | Air Compressor Control | Lead |
| 23 | Manual Sand | Lead |
| 24 | Dynamic Brake Excitation (Analog) | Lead |
| 25 | Headlight | Lead |
| 26 | Ground Relay Reset | Lead |
| 27 | Spare | Lead |

Signals sent along one or more of the MU lines may be used to transmit information over a first communication path, while modulated signals overlayed on one or more of the MU lines (e.g., lines 10 and 20 as indicate above) may be used to transmit information over a second communication path. For example, various combinations of the A, B, C, and D governor solenoid signals may be used to indicate a throttle notch integer setting (e.g., 1, 2, 3, 4, 5, 6, 7, 8) over the first communication path, while a throttle setting at a higher fidelity (e.g., 7.25) may be sent over the second communication path. A command for a throttle setting for all vehicles in a consist (e.g., a default setting) may be sent over the first communication path, while specifically targeted throttle commands may be sent to one or more individual vehicles over the second communication path. In some embodiments, a specifically targeted command may override the default command for the particular vehicle targeted if the specifically targeted command is received within a certain time frame of a time signature associated with the specifically targeted command.

As used herein, the term "MU cable system" refers to the entire MU cable system or any portion(s) thereof, e.g., terminal boards, ports, cable jumper, conduit portions, and the like. As should be appreciated, when two vehicles are connected via an MU cable jumper 252, both the MU cable jumper 252 and the internal MU electrical systems 240 of the two vehicles together are part of the MU cable system. As subsequent vehicles are attached using additional MU cable jumpers 252, those cable jumpers and the internal MU electrical systems 240 of the subsequent vehicles also become part of the MU cable system.

As should be appreciated, it may be the case that certain vehicles in a vehicle consist are equipped to de-modulate or de-capsulate (e.g., outfitted with a router transceiver unit) the data 217 (e.g., information sent over a second communication path 132), and that other vehicles in the consist are not equipped as such. For example, there may be first and third equipped vehicles physically separated by a second vehicle that is not equipped to de-modulate the data 217, but is equipped to receive and utilize data 216 sent over a first communication path using standard MU techniques (e.g., first communication path 130). In this case, the first and third vehicles are still able to communicate and exchange data via the second, or alternate, communication path even though there is a non-equipped vehicle between them. This may be possible due to the MU cable system 226 extending through the non-equipped vehicles. In one case, for example, a vehicle consist comprises first, second, and third vehicles, with the second vehicle being disposed between the first and third vehicles. A first router transceiver unit is positioned in the first vehicle, and a third router transceiver unit is positioned in the third vehicle. The second vehicle, however, does not have a router transceiver unit or other functionality for transmitting and/or receiving the data 217 over the MU cable system. Nevertheless, the data 217 is transmitted between the first and third vehicles through the second vehicle, with the network data passing through a portion of the MU cable system in the second vehicle but not being de-modulated, de-encapsulated, or otherwise analyzed by the second vehicle.

Returning to FIG. 2, the system network 210 may include the router transceiver units 234*a*, 234*b*, 234*c* of the respective vehicles 218*a*, 218*b*, 218*c*. The router transceiver units 234*a*, 234*b*, 234*c* may be each communicatively coupled to the MU cable system 226. The router transceiver units 234*a*, 234*b*, 234*c* are configured to transmit and/or receive data 216 (e.g., data in a standard MU format or other non-network data) as well as data 217 (e.g., data transmitted via a modulated signal over one or more wires or channels of a MU cable, such as via eMU, or other network data) over the MU cable system 226. The router/transceiver units 234*a*-234*c* may be incorporated into, for example, a communication module (e.g. communication modules 120, 150, 180. In some embodiments, the router transceiver units 234*a*, 234*b*, 234*c* are configured to change the data 217 into a different form so that the data 217 may be used by other operational components. For example, the router transceiver units 234*a*, 234*b*, 234*c* may be configured to decapsulate or demodulate the data 217 after the data 217 is received.

Figure 5:
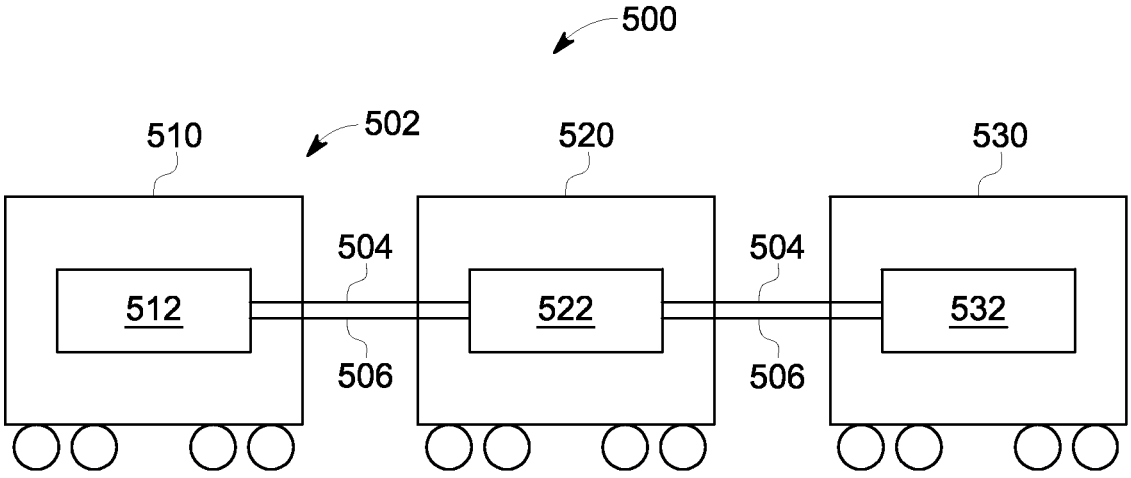
FIG. 5 is a schematic diagram of a communication and control system for a vehicle consist, according to an embodiment.

FIG. 5 illustrates an example of a system 500 including vehicles that are equipped to utilize information conveyed over a first communication path and an alternate communication path along with a vehicle that is equipped to utilize information conveyed over the first communication path but is not equipped to utilize information conveyed over the alternate communication path. The system 500 includes a consist 502 including a lead powered vehicle 510, a legacy powered vehicle 520, and a third powered vehicle 530. In the illustrated embodiment, the legacy powered vehicle 520 is interposed between the lead powered vehicle 510 and the third powered vehicle 530. The powered vehicles 510, 520, 530, of the consist 502 are communicatively coupled by a first communication path 504 (e.g., a standard MU line), and an alternate communication path 506 (e.g., an eMU system). The lead powered vehicle 510 and the third powered vehicle 530 are configured to communicate using the first communication path 504 and the second communication path 506. However, in the illustrated embodiment, the legacy powered vehicle 520 is an older vehicle that is equipped to communicate over the first communication path 504 but not equipped to communicate via the second communication path 506.

The lead powered vehicle 510 includes a lead communication module 512. The lead communication module 512 is configured to send, receive, and analyze messages using standard MU line techniques, as well as an alternate technique (e.g., eMU). Similarly, the third powered vehicle 530 includes an alternate path communication module 532. The alternate path communication module 532 is configured to send, receive, and analyze messages using standard MU line techniques, as well as an alternate technique (e.g., eMU).

Messages sent and received via the second communication path 506 may include a variety of information (see discussion above) and may be sent pursuant to a particular format. For example, in some embodiments, a command message from a lead powered vehicle may include a unique locomotive identifier portion (e.g., a serial number or other identification), a throttle command portion, a dynamic brake excitation portion, an additional command portion, as well as a spare portion to allow additions to be made to the command message format in the future. In some embodiments, a status message from a trail or remote vehicle may include a unique locomotive identifier portion (e.g., a serial number or other identification), a throttle command received portion identifying the throttle command that the remote vehicle received, a dynamic brake excitation received portion, an additional status value portion (e.g., any alarms or the like), and a spare portion. Messages may also include a message content CRC as well as a time stamp or other timing identifier, such as a sequence number. In some embodiments, the lead powered vehicle may send command messages at a rate so that remote powered vehicles have an opportunity to receive at least one message per second. In some embodiments, the remote powered vehicles may send status message so that the lead has an opportunity to receive at least one message every three seconds.

The legacy powered vehicle 520 includes a legacy communication module 522 that is configured to send, receive, and analyze messages using standard MU techniques with other vehicles in the consist 502. However, the legacy communication module 522 may not equipped to de-modulate, de-capsulate, or otherwise analyze messages sent over the second communication path 506. For example, an appropriate router transceiver device and other components for communicating via the second communication path 506 may not have been installed on the legacy vehicle 520. Thus, commands sent over the second communication path 506 may not be used to control operations of operational components of the legacy vehicle 520.

To provide operational commands to both the legacy powered vehicle 520 and the third powered vehicle 530, the lead powered vehicle may send a first command over the first communication path 504, and a second command over a second communication path 506. For example, in one example scenario, a trip plan (determined or provided to a control module (not shown) of the lead powered vehicle 510) calls for a throttle setting of 5.2 for all vehicles of the consist 502. Thus, the lead powered vehicle 510 may send, via the second communication path 506, an eMU message including a command for a throttle setting of 5.2. The third powered vehicle may then receive the command, control the operation of the third powered vehicle to operate at a throttle setting of 5.2, and send a confirmation message over the second communication path 506 to the lead powered vehicle 510. The first communication path may be a standard MU line that only allows integer values for a throttle setting. Thus, the lead powered vehicle 510 may send a message over the first communication path 504 calling for a throttle setting of 5. Thus, the lead powered vehicle may send messages over the first and second communication paths that both correspond to the same operation (e.g., a throttle setting.) The legacy powered vehicle 520 may only analyze the message sent over the first communication path 504, but the third powered vehicle may analyze both messages and select from between the two messages. Generally speaking, legacy vehicles may be older and/or less efficient than vehicles equipped to use both communication channels. Thus, in some example scenarios, higher throttle settings may be sent via the second communication path 506 and lower throttle settings may be sent via the first communication path 504.

In some embodiments, the third powered vehicle 530 may be configured to select the message sent via the second communication path 506 as long as the integrity of the message checks and the message was sent within a predetermined threshold time period. However, if the message sent via the second communication path 506 does not satisfy an integrity check (e.g., a CRC test), or is older than a predetermined time limit, the third powered vehicle 530 may disregard the message sent over the second communication path 506 and instead use the message sent over the first communication path 504. Thus, the first communication path 504 may serve as a backup for the second communication path 506. In some embodiments, if a command received via the second communication path 506 is more restrictive (e.g., calls for the vehicle to be operated at a slower rate) than a command received via the first communication path 504, then the command received via the second communication path 506 may be followed.

Further still, in embodiments with additional vehicles, all legacy vehicles may be controlled using a message sent via the first communication path 504, and individual commands may be sent to vehicles equipped to use messages from the second communication path 506. Thus, different vehicles may receive different commands and be controlled differently (e.g., different vehicles may operate at different throttle settings).

Status messages may also be communicated to the lead powered vehicle via the first and second communication paths 504, 506. For example, the third powered vehicle 530 may report status messages to the lead powered vehicle 510 that include identification information specifying that the status message is from the third powered vehicle 530, as well as information describing the nature and/or severity of any alarms. The legacy powered vehicle 520, however, may only return an alarm via the first communication path 520. In some embodiments, the lead powered vehicle may be able to determine that the alarm originated with the legacy powered vehicle 520 (or one of plural legacy powered vehicles) by querying all vehicles equipped to communicate via the second communication path. If all vehicles equipped to communicate via the second communication path respond with status messages indicating that an alarm did not originate with that particular vehicle, then the lead powered vehicle may determine that the alarm originated from a legacy powered vehicle.

Thus, embodiments of the present inventive subject matter allow compatibility of vehicles equipped to use an alternate communication path with vehicles not equipped to use the alternate communication path within the same consist. Embodiments also provide improved redundancy and back-up of command and/or status messages. Further, embodiments provide for the beneficial use of increased information that may be communicated by vehicles with more up-to-date communicative functionality, while not requiring the expense of replacing all vehicles in a consist.

Figure 6:
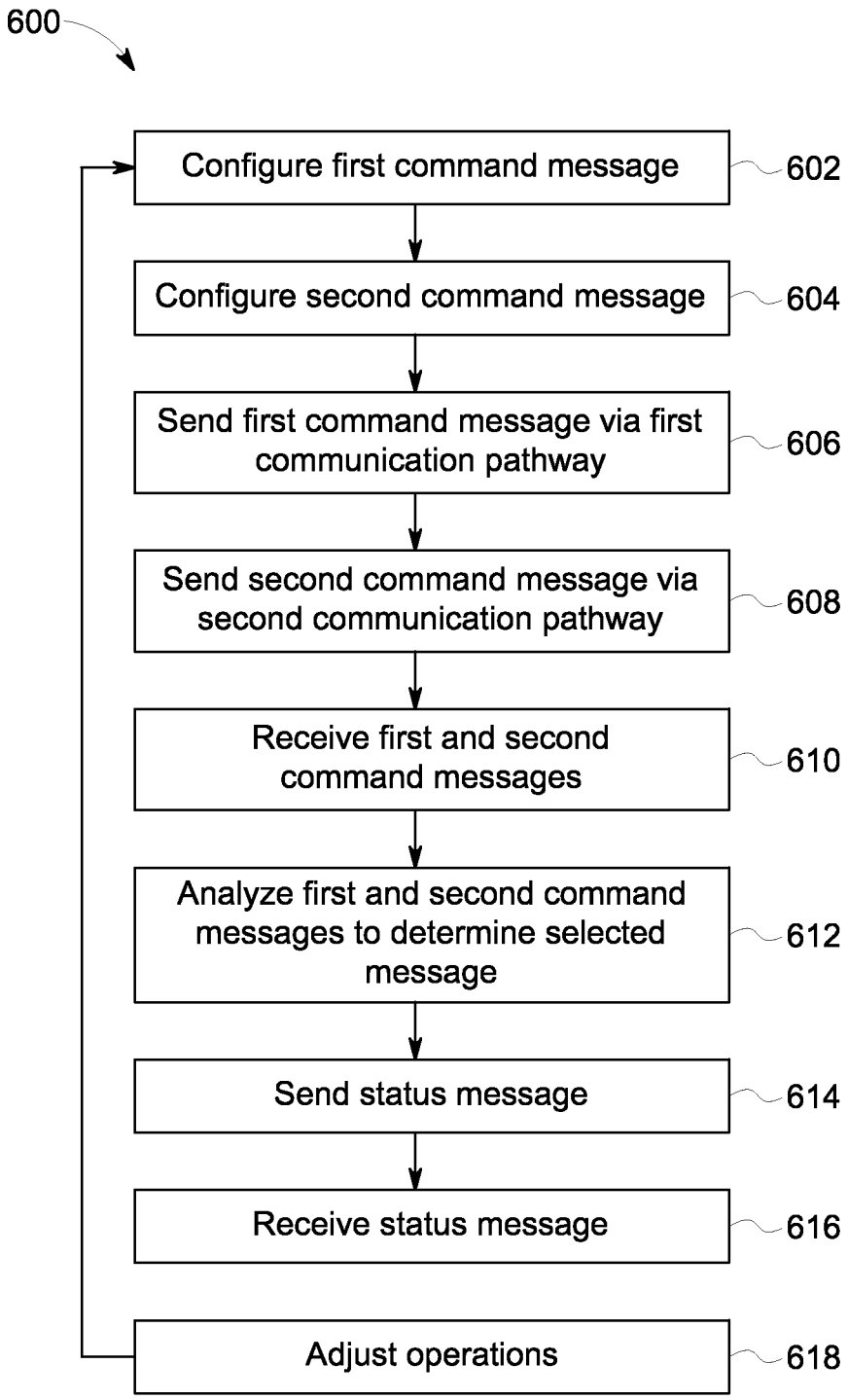
FIG. 6 illustrates a flowchart of a method for communicating between different vehicles of a vehicle system in accordance with one embodiment.

FIG. 6 illustrates a flowchart of a method 600 for communicating between different vehicles of a vehicle system in accordance with one embodiment. The method 600 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 602, a first command message is configured. The first command message may be configured, for example, at a control module of a lead powered vehicle of a consist, and may be determined pursuant to a trip plan. The first command message, in some embodiments, includes information describing a tractive and/or braking effort to be performed by one or more remote powered vehicles of the consist. The first command message is configured to be sent over a first communication path. In some embodiments, the first communication path is a standard MU line. Thus, the first command message may include a message configured to be sent over one or more of the individual wire and pin combinations of a MU cable.

At 604, a second command message is configured. The second command message may be configured, for example, at a control module of a lead powered vehicle of a consist, and may be determined pursuant to a trip plan. The second command message, in some embodiments, includes information describing the same operation (e.g., a tractive and/or braking effort) as the first command message to be performed by one or more remote powered vehicles of the consist. The second command message, however, may have a higher fidelity, additional information (e.g. timing information, more detailed information, additional commands, or the like), and/or may be targeted for a particular vehicle or group of vehicles. For example, by targeting or tailoring a command message for a particular vehicle, different vehicles may receive different commands for improved flexibility of control of an entire consist. For instance, in some embodiments, more fuel efficient powered vehicles may be assigned higher throttle settings than less fuel efficient powered vehicles. The second command message is configured to be sent over a second communication path. The second communication path may be physically separate from the first communication path (e.g., an Ethernet cable separate from the MU cable), or may be part of a shared physical structure with the first communication path (e.g., a standard MU line over which modulated signals are sent).

At 606, the first command message is sent over the first communication path, and, at 608, the second command message is sent over the second communication path.

At 610, the first command message and the second command message are received at a remote powered vehicle. For example, the first and second command messages may be received by a communication module configured to de-modulate or de-capsulate the information sent via the second communication path (e.g., via eMU) for further analysis or use. The remote powered vehicle may be coupled to the lead powered vehicle, either directly or indirectly, via a MU line and/or other hardwired connection. In some embodiments, a consist may include one or more remote powered vehicles that are configured to communicate via both the first and second communication paths, and one or more remote powered vehicles that are not configured to communicate via the second communication path.

At 612, for vehicles configured to communicate using both first and second communication paths, the first and second messages are analyzed and a selected command message is selected from between the first and second messages. In various embodiments, different selection criteria may be employed by a given remote powered vehicle for determining the selected command message. By way of example, timing information may be utilized to select a command message. For instance, in some embodiments, if the second message (sent via the second communication path) is determined to not be current or to otherwise not satisfy a timing consideration, then the first message (sent via the first communication path) may be selected. Additionally or alternatively, if the second message does not satisfy an integrity check (e.g., CRC test), then the first message may be selected. If the second message is determined to be within a time threshold and is determined to pass an integrity check, then the second message may be selected. As another example, if it is determined that the second message was intended for a different recipient vehicle, then the first message may be selected. As still another example, the restrictiveness of the messages may be compared. Restrictiveness may be understood as the amount of inhibition placed on the motion of the powered vehicle (e.g., a braking command would be more restrictive than a low throttle command which would be more restrictive than a high throttle command). For example, if the second message is more restrictive than the first message, the second message may be selected. As another example, for a consist where one or more vehicles are not equipped to communicate via the second communication path, the less restrictive path may be selected by the vehicles equipped to communicate via the second path.

At 614, a status message is sent from a remote powered vehicle to the lead powered vehicle. For example, the status message may be sent as a confirmation of the receipt of the first and/or second messages. The status message may be sent over the second communication path and may include information identifying the message command received, the message command selected and/or implemented, timing information regarding the status message, and/or additional information such as an alarm, fuel availability indication, or the like. The status information sent over the second communication channel may also identify the particular powered vehicle from which the status message is sent. Further, in some embodiments a corresponding status message may be sent over the first communication path (albeit at a lower level of detail) that acts as a backup status to the message sent over the second communication path.

At 616, the lead powered vehicle receives the status message. For example, the status message may be received by a communication module configured to de-modulate or de-capsulate the information sent (e.g., via eMU) for further analysis or use.

At 618, one or more operations of the consist are adjusted responsive to one or more status messages received by the lead powered vehicle. For example, a throttle command may be reduced to a first remote vehicle experiencing an issue, such as low fuel, while a throttle command may be increased to one or more other powered vehicles to counter the reduced power from the first remote vehicle. In some embodiments, the status message may be checked (to satisfy a time threshold and/or an integrity check) before any operations are adjusted based on the status message. The adjustment of the one or more operations may be accomplished by sending additional commands, with the method 600 returning to 602 to configure and send the additional commands.

Embodiments may also include computer readable media with instructions that are configured to direct a processor to execute or perform the various method operations described herein. Embodiments may also include powered vehicles including the various modules and/or components or vehicle networks described herein. Moreover, embodiments described herein may include vehicle consists that include the various modules and/or components, the vehicle networks, or the system networks described herein.

In one embodiment, a system is provided that includes a first communication module and a second communication module. The first communication module is configured to be disposed onboard a first vehicle of a vehicle consist, and the second communication module is configured to be disposed onboard a second vehicle of the vehicle consist. The first and second communication modules are communicatively coupled by first and second communication paths. The first and second communication modules are configured to communicate first information over the first communication path, and to communicate second information over the second communication path. At least a portion of the first information includes a first command corresponding to a first operation of at least one of the first or second vehicles. At least a portion of the second information includes a second command corresponding to the first operation.

In another aspect, the first communication path includes a multiple unit (MU) line, and the first and second communication modules are configured to communicate the first information using industry standard MU signals over the first communication path. Further, in some embodiments, the first and second communication modules are configured to communicate the second information using modulated signals overlayed on the MU line.

In another aspect, the first command includes command information at a first fidelity, and the second command includes command information at a second fidelity, with the second fidelity higher than the first fidelity.

In another aspect, the first and second communication modules are configured to communicate timing information identifying a timing corresponding to the second information communicated over the second communication path. In some embodiments, at least one of the first or second communication modules is configured to disregard the second information based on an elapsed time corresponding to the timing information exceeding a threshold. Further, in some embodiments, at least one of the first or second communication modules is configured to disregard the first information and use the second information to perform a vehicle control operation when an elapsed time corresponding to the timing information does not exceed a threshold.

In another aspect, the second information includes error checking information configured to allow the integrity of a message including the second information to be checked.

In another aspect, the first vehicle is configured as a lead powered vehicle of the consist, and the second vehicle is configured as a remote powered vehicle of the consist.

In another aspect, the second information includes status information describing a status of the second vehicle. The status information is communicated from the second communication module to the first communication module.

In another aspect, the second information includes information identifying the second vehicle as at least one of an intended recipient or a source of the second information.

In another aspect, the second information includes command information for use by the second vehicle but not for use by any other vehicles.

In another aspect, the system includes a first control module configured to be disposed onboard the first vehicle. The first control module is configured to adjust one or more commands to be communicated over the first or second communication paths based on information received over the second communication path.

In another aspect, the system includes a control module configured to be disposed onboard the second vehicle. The control module is configured to select a selected command from between a first command received via the first communication path and a second command received via the second communication path. The control module is configured to control the second vehicle using the selected command. In some embodiments, the control module may be configured to select the selected command based on a timing of the second information. In some embodiments, the control module is configured to select a less restrictive command of the first of second commands as the selected command if a timing of the second information satisfies a threshold.

In another aspect, the first communication module is configured as a lead communication module configured to be disposed onboard a lead powered vehicle of a vehicle consist. The second communication module is configured as one of plural remote communication modules configured to be disposed onboard corresponding plural remote powered vehicles of the vehicle consist. The lead and plural remote communication modules are communicatively coupled by the first communication path and the second communication path. The first command corresponds to a given operation of at least one of the remote vehicles, and the second command corresponds to the given operation of the at least one of the remote powered vehicles.

In another aspect, the plural remote communication modules include at least one alternate path communication module and at least one legacy communication module. The at least one alternate path communication module is configured to extract the second information from a message sent via the second path. The at least one legacy communication module is not configured to extract the second information from the message sent via the second, wherein a legacy vehicle on which the at least one legacy communication module is disposed may be controlled using the first information but not the second information.

In another embodiment, a system includes a first communication module configured to be disposed onboard a first vehicle of a vehicle consist. The first communication module is configured to be communicatively coupled by first and second communication paths to a second communication module that is configured to be disposed onboard a second vehicle. The first communication module is configured to communicate, with the second communication module, first information over the first communication path and second information over the second communication path. At least a portion of the first information comprises a first command corresponding to a first operation of at least one of the first or second vehicles, and at least a portion of the second information comprises a second command corresponding to the first operation of the at least one of the first or second vehicles.

In another aspect, the system may include a first control module configured to be disposed onboard the first vehicle. The first control module is configured to adjust one or more commands to be communicated over the first or second communication paths based on information received over the second communication path.

In another embodiment, a method (e.g., a method for controlling operations of a consist) is provided that includes communicating first information via a first communication path to plural communication modules of plural respective remote powered vehicles of the consist. The first information includes a first command corresponding to a first operation, and is communicated from a lead communication module of a lead powered vehicle of the consist. The method also includes communicating second information including a second command also corresponding to the first operation. The second command is communicated via a second communication path that communicatively couples the lead powered vehicle and the remote powered vehicles. The second command is communicated from the lead communication module of the lead powered vehicle to at least one of the remote communication modules. The method also includes controlling at least one of the plural remote vehicles to perform the first operation pursuant to at least one of the first command or the second command.

In another aspect, the method includes determining the first information at a control module disposed on board the lead vehicle of the consist, and determining the second information on board the lead vehicle of the consist.

In another aspect, the method includes communicating status information from at least one of the remote vehicles via the second communication path. In some embodiments, the status information includes confirmation information confirming that the at least one of the remote vehicles has received the second command. In some embodiments, the status information includes identification information describing a particular one of the remote vehicles to which the status information corresponds.

In another aspect, the second information includes timing information corresponding to a timing of the second command.

In another aspect, the method includes selecting a selected command from the first command and the second command based upon an elapsed time corresponding to the second information.

In another aspect, at least one of the remote vehicles performs the first operation pursuant to the first command, and at least one of the remote vehicles performs the first operation pursuant to the second command.

In another aspect, the second information includes identification information identifying a specific one of the remote vehicles for which the second command has been configured.

In another embodiment, a system comprises a first communication module configured to be disposed onboard a first vehicle of a vehicle consist. The first communication module is configured to be communicatively coupled by first and second communication paths to a second communication module configured to be disposed onboard a second vehicle. The first communication module is further configured to communicate, with the second communication module, first information over the first communication path and second information over the second communication path, wherein at least a portion of the first information comprises a first command corresponding to a first operation of at least one of the first or second vehicles, and at least a portion of the second information comprises a second command corresponding to the first operation of the at least one of the first or second vehicles. The first communication module includes a portable housing (e.g., can be carried by a human), with all the circuitry of the first communication module for carrying out the indicated functionality being housed in the portable housing. The first communication path is an MU line, and the first communication module is configured to communicate the first information using industry standard MU signals over the MU line. The second communication path is also the MU line (or a different line in the same MU cable). The second information is received by the first communication module as network data (e.g., Ethernet data), and the first communication module is configured to modulate/convert the network data into modulated network data for transmission over the second communication path at a high bandwidth. The second communication path is not configured to transmit the network data at a high bandwidth (e.g., due to electrical/physical limitations of the second communication path), thus, the first communication module is configured to convert the network data into modulated signals that can successfully propagate over the second communication path at the high bandwidth rate. Therefore, the first communication module provides both standard/legacy MU communications over an MU cable and high bandwidth network data communications over the MU cable, in a single device of the portable housing.

As discussed above, in embodiments, a first communication module is configured to communicate first information with a second communication module over a first communication path and second information with the second communication module over a second communication path. In any such embodiments, it may be the case that the second communication path is not configured for transmission of the second information as initially received by the first communication module, and therefore, that the first communication module is configured to convert the second information, as initially received, into modulated signals for transmission over the second communication path. For example, the second information may be received by the first communication module over a third communication path, such as a network cable or bus, in a first format and at a first transmission rate/bandwidth. The second communication path, due to its electro-mechanical properties, is not capable of carrying the second information in the first format at the first transmission rate/bandwidth. However, the first communication module is configured to convert the second information, from the first format into a different, second format (the modulated signals), which is compatible with the second communication path at the first transmission rate/bandwidth. In one specific example, the second communication path is an MU line. The second information, comprising network data, is received by the first communication module at a high bandwidth rate (average rates of 10 Mbit/sec or greater) over a CAT-5E or similar cable, in a first format for transmission of the second information over the CAT-5E cable at the high bandwidth rate. The MU line, based on the properties of the wires that comprise the MU line, physically cannot carry the second information, at the first format, at the high bandwidth rate. Thus, the first communication module converts the second information, from the first format, into modulated signals at a second format, which the MU line is capable of carrying at the high bandwidth rate. Recipient communication modules (e.g., the second communication module) may be configured to convert the received modulated signals back into the first format.

The various components (e.g., the router transceiver units) and modules described herein may be implemented as part of one or more computers, computing systems, or processors. The computer, computing system, or processor may include a microprocessor. The microprocessor may be connected to a communication bus. The computer or processor may also include a memory. The memory may include Random Access Memory (RAM) and Read Only Memory (ROM). The computer or processor further may include a storage system or device, which may be a hard disk drive or a removable storage drive such as a floppy or other removable disk drive, optical disk drive, and the like. The storage system may also be other similar means for loading computer programs or other instructions into the computer or processor. The instructions may be stored on a tangible and/or non-transitory computer readable storage medium coupled to one or more servers.

As used herein, the term "computer" or "computing system" may include any processor-based or microprocessor-based system including systems using microcontrollers, reduced instruction set computers (RISC), application specific integrated circuits (ASICs), logic circuits, and any other circuit or processor capable of executing the functions described herein. The above examples are exemplary only, and are thus not intended to limit in any way the definition and/or meaning of the term "computer" or "computing system."

The set of instructions may include various commands that instruct the computer or processor as a processing machine to perform specific operations such as the methods and processes described herein. The set of instructions may be in the form of a software program. The software may be in various forms such as system software or application software. Further, the software may be in the form of a collection of separate programs, a program module within a larger program or a portion of a program module. The software also may include modular programming in the form of object-oriented programming. The processing of input data by the processing machine may be in response to user commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings without departing from its scope. While the dimensions and types of materials described herein are intended to define the parameters, they are by no means limiting and are exemplary embodiments. Many other embodiments will be apparent to one of ordinary skill in the art upon reviewing the above description. The scope should, therefore, be determined with reference to the appended claims, along with the full scope of equivalents to which such claims are entitled. In the appended claims, the terms "including," "includes," and "in which" are used as the plain-English equivalents of the respective terms "comprising," "comprises," and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments, and also to enable any person skilled in the art to practice the embodiments, including making and using any devices or systems and performing any incorporated methods. The patentable scope is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method for communicating data in a vehicle system or consist, without departing from the spirit and scope of the embodiments described herein, it is intended that all of the subject matter of the above description or shown in the accompanying drawings shall be interpreted merely as examples illustrating the inventive subject matter herein and shall not be construed as limiting.

The invention claimed is:

1. A system comprising:

a first communication module comprising a first at least one processor and a first memory, the first communication module disposed onboard a first vehicle of a vehicle consist;

a second communication module comprising a second at least one processor and a second memory, the second communication module disposed onboard a second vehicle of the vehicle consist;

the first and second communication modules communicatively coupled by first and second communication paths;

the first and second communication modules configured to communicate first information over the first communication path and second information over the second communication path, wherein at least a portion of the first information comprises first command information corresponding to a first operation of at least one of the first or second vehicles, and at least a portion of the second information comprises second command information corresponding to the first operation of the at least one of the first or second vehicles, wherein the first command information comprises identical commands transmitted to plural vehicles of the consist and the second command information comprises a tailored command corresponding to the first operation of the at least one of the first or second vehicles, wherein the first command information does not include identifying information for which vehicle the first command information is intended, and wherein the tailored command is different than the identical commands; and a control module comprising a third at least one processor, the control module disposed onboard the at least one of the first or second vehicles and configured to control the at least one of the first or second vehicles to perform the first operation pursuant to at least one of the first command information or the second command information.

2. The system of claim 1, wherein the first communication path comprises a multiple unit (MU) line, and the first and second communication modules are configured to communicate the first information using industry standard MU signals over the first communication path.

3. The system of claim 2, wherein the first and second communication modules are configured to communicate the second information using modulated signals overlayed on the MU line.

4. The system of claim 1, wherein the first command information comprises command information at a first fidelity, and the second command information comprises command information at a second fidelity, and wherein the second fidelity is higher than the first fidelity.

5. The system of claim 1, wherein the first and second communication modules are configured to communicate timing information identifying a timing corresponding to the second information communicated over the second communication path.

6. The system of claim 5, wherein at least one of the first or second communication modules is configured to disregard the second information based on an elapsed time corresponding to the timing information exceeding a threshold.

7. The system of claim 5, wherein at least one of the first or second communication modules is configured to disregard the first information and use the second information to perform a vehicle control operation when an elapsed time corresponding to the timing information does not exceed a threshold.

8. The system of claim 1, wherein the second information includes error checking information configured to allow the integrity of a message including the second information to be checked.

9. The system of claim 1, wherein the first vehicle is configured as a lead powered vehicle of the consist, and the second vehicle is configured as a remote powered vehicle of the consist.

10. The system of claim 1, wherein the second information includes status information describing a status of the second vehicle communicated from the second communication module to the first communication module.

11. The system of claim 1, wherein the second information includes information identifying the second vehicle as at least one of an intended recipient or a source of the second information.

12. The system of claim 1, wherein the second information includes command information for use by the second vehicle but not for use by any other vehicles.

13. The system of claim 1, wherein the control module is configured to adjust one or more commands to be communicated over the first or second communication paths based on information received over the second communication path.

14. The system of claim 1, wherein the control module is configured to be disposed onboard the second vehicle, the control module configured to select a selected command from between the first command information received via the first communication path and the second command information received via the second communication path, wherein the control module is configured to select the second command information when the second command information is able to be implemented and to select the first command information when the second command information is not able to be implemented, the control module configured to control the second vehicle using the selected command information.

15. The system of claim 14, wherein the control module is configured to select the selected command information based on a timing of the second information.

16. The system of claim 15, wherein the control module is configured to select a less restrictive command of the first or second command information as the selected command information if the timing of the second information satisfies a threshold.

17. The system of claim 1, wherein the first communication module is configured as a lead communication module configured to be disposed onboard a lead powered vehicle of the vehicle consist, the system further comprising:

plural remote communication modules configured to be disposed onboard corresponding plural remote powered vehicles of the vehicle consist, wherein the second communication module is configured as one of the plural remote communication modules;

wherein the lead and plural remote communication modules are communicatively coupled by the first communication path and the second communication path; and wherein the lead and remote communication modules are configured to communicate the first information over the first communication path and the second information over the second communication path, wherein the first command information corresponds to a given operation of at least one of the remote powered vehicles, and the second command information corresponds to the given operation of the at least one of the remote powered vehicles.

18. The system of claim 17, wherein the plural remote communication modules include at least one alternate path communication module and at least one legacy communication module, the at least one alternate path communication module configured to extract the second information from a message sent via the second communication path, the at least one legacy communication module not configured to extract the second information from the message sent via the second communication path, wherein a legacy vehicle on which the at least one legacy communication module is disposed may be controlled using the first information but not the second information.

19. A system comprising a first communication module and a control module, the first communication module disposed onboard a first vehicle of a vehicle consist, the first communication module comprising a first at least one processor and a first memory, the control module comprising a second at least one processor and a second memory, wherein the first communication module is configured to be communicatively coupled by first and second communication paths to a second communication module configured to be disposed onboard a second vehicle, wherein the first communication module is configured to communicate, with the second communication module, first information over the first communication path and second information over the second communication path, wherein at least a portion of the first information comprises first command information corresponding to a first operation of at least one of the first or second vehicles, and at least a portion of the second information comprises second command information corresponding to the first operation of the at least one of the first or second vehicles, wherein the first command information comprises identical commands transmitted to plural vehicles of the consist and the second command information comprises a tailored command corresponding to the first operation of the at least one of the first or second vehicles, wherein the first command information does not include identifying information for which vehicle the first command information is intended, and wherein the tailored command is different than the identical commands, the control module disposed onboard the at least one of the first or second vehicles and configured to control the at least one of the first or second vehicles to perform the first operation pursuant to at least one of the first command information or the second command information.

20. The system of claim 19, wherein the control module is configured to be disposed onboard the first vehicle and is configured to adjust one or more commands to be communicated over the first or second communication paths based on information received over the second communication path.

21. A method for controlling operations of a vehicle consist, the method comprising:

communicating first information comprising a first command corresponding to a first operation via a first communication path to plural communication modules of plural respective remote powered vehicles, the first command comprising identical commands transmitted to the plural communication modules of the plural respect remote powered vehicles, wherein the first command is communicated from a lead communication module of a lead powered vehicle of the consist to the plural remote communication modules, wherein the first command does not include identifying information for which vehicle the first command information is intended;

communicating second information comprising a second command corresponding to the first operation via a second communication path that communicatively couples the lead powered vehicle and the remote powered vehicles, wherein the second command is communicated from the lead communication module of the lead powered vehicle of the consist to at least one of the remote communication modules, the second command tailored for a particular one of the remote powered vehicles, wherein the second command is different than the identical commands; and controlling at least one of the plural remote powered vehicles to perform the first operation pursuant to at least one of the first command or the second command.

22. The method of claim 21, further comprising:

determining, at a control module disposed on board the lead vehicle of the consist, the first information; and determining, at the control module disposed on board the lead vehicle of the consist, the second information.

23. The method of claim 21, further comprising:

communicating status information from at least one of the remote powered vehicles via the second communication path.

24. The method of claim 23, wherein the status information comprises confirmation information confirming that the at least one of the remote powered vehicles has received the second command.

25. The method of claim 23, wherein the status information comprises identification information describing the particular one of the remote powered vehicles to which the status information corresponds.

26. The method of claim 21, wherein the second information includes timing information corresponding to a timing of the second command.

27. The method of claim 21, further comprising selecting a selected command from the first command and the second command based upon an elapsed time corresponding to the second information.

28. The method of claim 21, wherein at least one of the remote powered vehicles performs the first operation pursuant to the first command, and the particular one of the remote powered vehicles performs the first operation pursuant to the second command.

29. The method of claim 21, wherein the second information includes identification information identifying the particular one of the remote powered vehicles for which the second command has been configured.

* * * * *